US006192589B1

(12) United States Patent
Martone et al.

(10) Patent No.: US 6,192,589 B1
(45) Date of Patent: Feb. 27, 2001

(54) UTILITY KNIFE

(75) Inventors: Joseph R. Martone, Bristol, CT (US); Richard Gilbert, Dronfield (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/344,485

(22) Filed: Jun. 25, 1999

(51) Int. Cl.[7] ..... B26B 1/08; B26B 1/10
(52) U.S. Cl. ..... 30/125; 30/162
(58) Field of Search ..... 30/125, 162, 335, 30/336

(56) References Cited

U.S. PATENT DOCUMENTS

| | | | | |
|---|---|---|---|---|
| 3,593,417 | * | 7/1971 | West | 30/125 |
| 3,708,881 | | 1/1973 | Bennett | 30/320 |
| 3,845,554 | | 11/1974 | Joanis et al. | 30/125 |
| 3,872,591 | | 3/1975 | Quenot | 30/162 |
| 3,879,847 | | 4/1975 | Roll | 30/162 |
| 3,943,627 | | 3/1976 | Stanley, Jr. | 30/151 |
| 3,964,162 | | 6/1976 | Gerson et al. | 30/162 |
| 4,196,515 | | 4/1980 | Sugiyama | 30/162 |
| 4,408,396 | | 10/1983 | Scholl | 30/294 |
| 4,425,709 | | 1/1984 | Quenzi | 30/151 |
| 4,586,256 | | 5/1986 | Weimann | 30/162 |
| 4,612,707 | | 9/1986 | Shea | 30/162 |
| 4,706,385 | | 11/1987 | Iten | 30/169 |
| 4,884,342 | | 12/1989 | McNamara et al. | 30/162 |
| 5,303,474 | | 4/1994 | Keklak et al. | 30/162 |
| 5,426,855 | | 6/1995 | Keklak et al. | 30/162 |
| 5,613,300 | * | 3/1997 | Schmidt | 30/125 X |
| 5,784,788 | | 7/1998 | Cothery | 30/294 |
| 5,890,294 | * | 4/1999 | Keklak et al. | 30/125 |
| 6,000,136 | * | 12/1999 | Owens | 30/125 X |

* cited by examiner

*Primary Examiner*—Douglas Watts
(74) *Attorney, Agent, or Firm*—Pillsbury Winthrop LLP

(57) ABSTRACT

A utility knife that includes a main body, a blade holder assembly movably mounted within the body and a manually engageable member slidably mounted on the main body. The blade holder assembly is constructed and arranged to mount a blade within the main body. The blade holder is movable between a retracted position wherein the blade is disposed within the main body and an extended position wherein the blade protrudes outwardly from the main body to enable a cutting operation. The manually engageable member is operatively connected with the blade holder assembly and is movable to move the blade holder assembly between its extended and retracted positions. The utility knife further includes a blade storage member pivotally connected with the main body. The blade storage member is constructed and arranged to carry a supply of spare blades and is movable between a closed position wherein the spare blades are concealed and a fully opened position permitting access to the spare blades. The utility knife also includes releasable locking structure that is constructed and arranged to releasably lock the blade storage member in its closed position. Interengaging structure is provided between the blade storage member and the main body to prevent movement of the blade storage member from the closed position to the fully opened position under the force of gravity when the locking structure is released to unlock the blade storage member from the closed position.

6 Claims, 10 Drawing Sheets

UTILITY KNIFE

FIELD OF THE INVENTION

The present invention relates to utility knives with replaceable blades.

BACKGROUND OF THE INVENTION

Utility knives are widely used in industry and the building trades and typically employ a replaceable cutting blade movably mounted between extended and retracted positions with respect to a main body of the utility knife. Specifically, the blade is typically releasably mounted to a blade holder that is in turn movably mounted within the main body to move the blade between retracted and extended positions. The blades must be replaced as they become dull or break. A supply of replacement blades may be stored within the main body portion of some utility knives. When a blade needs to be replaced, the user removes a new blade from the main body, releases the old blade from the blade holder, releasably mounts the new blade on the blade holder.

Removing a replacement blade from the main body frequently requires the user to partially disassemble the utility knife which can be time-consuming and may require the use of additional tools. Often, for example, the main body is comprised of two halves secured together with a screw or other fastener which must be removed before the user can access the supply of new blades and/or replace the old blade. The fasteners for most utility knives are exposed in the assembled utility knife in the gripped area of the main body which is undesirable because these fasteners detract from the aesthetic appearance of the knife. Other utility knives provide a blade storage member that stores spare blades in a concealed manner within the body. The blade storage member is movable with respect to the main body and enables access to the spare blades.

In some commercial embodiments such a blade storage member has been pivotally mounted to the main body and pivoted downwardly to a fully opened position to permit access to the spare blades. While this embodiment has met considerable commercial success, it would be advantageous to provide a more controlled movement of the blade storage member to the fully opened position so as to prevent the possibility that the force of gravity causes the storage member to rapidly swing open, which may cause the blades to fall out of the storage member under the force of gravity.

Existing utility knives provide a wide range of mechanisms for releasing the old blade from the blade holder. Some utility knives require the main body to be disassembled into two halves (by, for example, removing a screw) to remove the blade. This is undesirable because disassembly and reassembly is inconvenient and time consuming. Other utility knives allow the old blade to be removed without disassembly, but include a blade releasing structure that is operatively associated with the blade holder to release the blade. The conventional blade releasing structure may include a manually engageable button that is mounted from within the main body and protrudes from the body for manual engagement to release the blade. The button is not fixed to either body half. Thus, when the body halves are separated (e.g., for cleaning the inside of the knife), the button may fall out and be misplaced. In addition, reassembly of the knife becomes tedious and time consuming.

A need exists for a utility knife that allows the user to remove spare blades therefrom by opening the main body thereof in a controlled, gradual manner. A Further need exists for a utility knife that includes a blade releasing structure that is operatively associated with the blade holder for releasing the blade when the utility knife is in its assembled condition, but which will remain attached to a portion of the main body when the utility knife is disassembled. A further need exists for a utility knife which has its fasteners concealed for an improved aesthetic appearance.

SUMMARY OF THE INVENTION

To meet the needs described above, the present invention provides a utility knife that includes a main body, a blade holder assembly movably mounted within the body and a manually engageable member slidably mounted on the main body. The blade holder assembly is constructed and arranged to mount a blade within the main body. The blade holder is movable between a retracted position wherein the blade is disposed within the main body and an extended position wherein the blade protrudes outwardly from the main body to enable a cutting operation. The manually engageable member is operatively connected with the blade holder assembly and is movable to move the blade holder assembly between its extended and retracted positions. The utility knife further includes a blade storage member pivotally connected with the main body. The blade storage member is constructed and arranged to carry a supply of spare blades and is movable between a closed position wherein the spare blades are concealed and a fully opened position permitting access to the spare blades. The utility knife also includes releasable locking structure that is constructed and arranged to releasably lock the blade storage member in its closed position. Interengaging structure is provided between the blade storage member and the main body to prevent movement of the blade storage member from the closed position to the fully opened position under the force of gravity when the locking structure is released to unlock the blade storage member from the closed position.

In accordance with another aspect of the present invention, the main body of the utility knife comprises two body halves and a fastener secures the halves to one another. The blade storage member conceals the fastener when the blade storage member is in its closed position.

In accordance with another aspect of the present invention, the utility knife includes a blade releasing structure associated with the blade holder assembly. The blade releasing structure includes a manually engageable portion that is movable to disengage the blade from the blade holder assembly to enable the blade to be removed from the blade holder assembly. The blade releasing structure includes an attachment portion that is connected with one of the body halves of the main body of utility knife. This attachment portion retains the blade releasing structure with the one body half when the body halves are disconnected from one another.

Other objects, features, and advantages of the present invention will become apparent from the following detailed description, the accompanying drawings, and the appended claims.

BRIEF DESCRIPTION OF THE DRAWINGS

FIG. 11 is a side elevational view of the utility knife showing an upper gripping member in exploded relation there with.

DETAILED DESCRIPTION OF THE PREFERRED EMBODIMENT AND BEST MODE OF THE INVENTION

Figure 1:
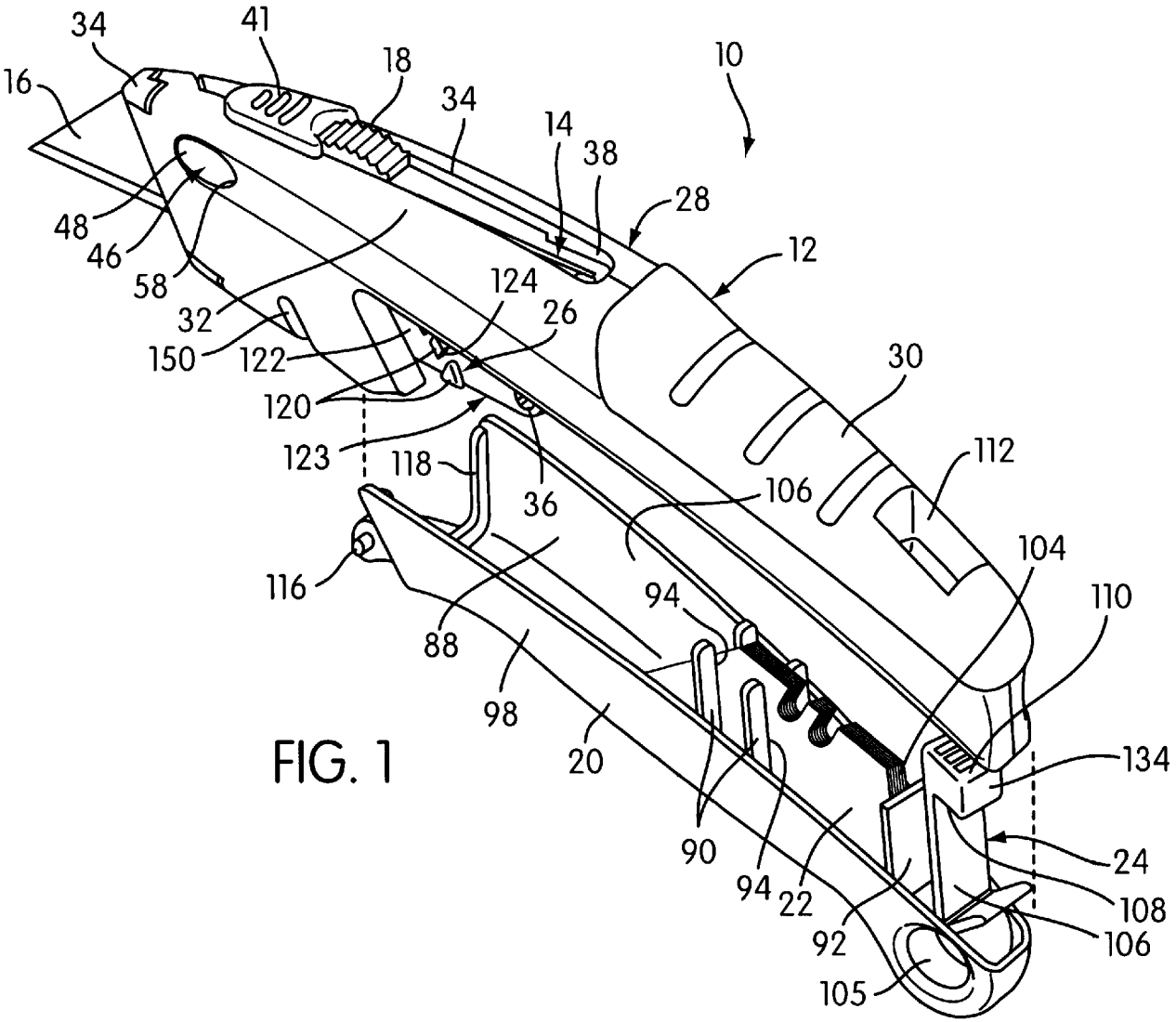
FIG. 1 shows a utility knife constructed according to the principles of the present invention and shows in exploded relation thereto a blade storage member which contains a plurality of blades stored therein.

FIGS. 1–4 show a utility knife, generally designated at 10, constructed according to the principles of the present invention. The utility knife 10 includes a main body 12 and a blade holder assembly 14 movably mounted within the main body 12. The blade holder assembly 14 may be of conventional construction and is constructed and arranged to mount a conventional utility knife blade 16.

The blade holder assembly 14 is movable between a retracted position (not shown) wherein the blade 14 is disposed within the main body 12 and an extended position (shown, for example, in FIG. 2) wherein the blade 16 protrudes outwardly from the main body 12 to enable a cutting operation. The extended position may include not only a fully extended position, but may also include at least one intermediate position wherein the blade can be releasably locked at a position in which only a part of the possible extent of the blade extends from the main body. A manually engageable member 18 is slidably mounted on the main body 12 and is operatively connected with the blade holder assembly 14 such that movement of the manually engageable member 18 moves the blade holder assembly 14 between the extended and retracted positions.

Figure 2:
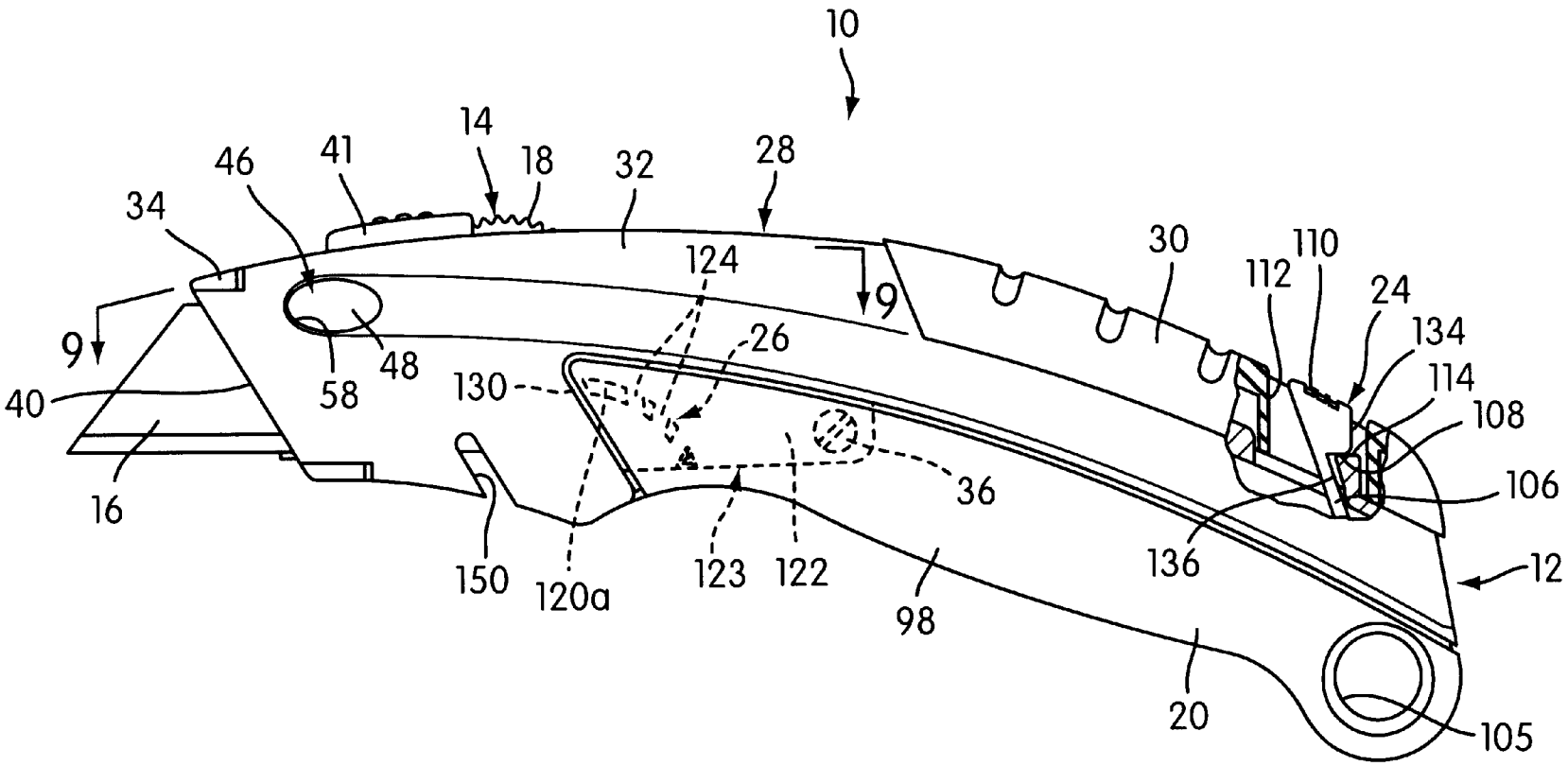
FIG. 2 is a side elevational view of the utility knife showing interengaging structure thereof and a fastener thereof in phantom lines and showing a portion the utility knife broken away to show releasable locking engagement between the blade storage member and a body structure of the utility knife.
Figure 3:
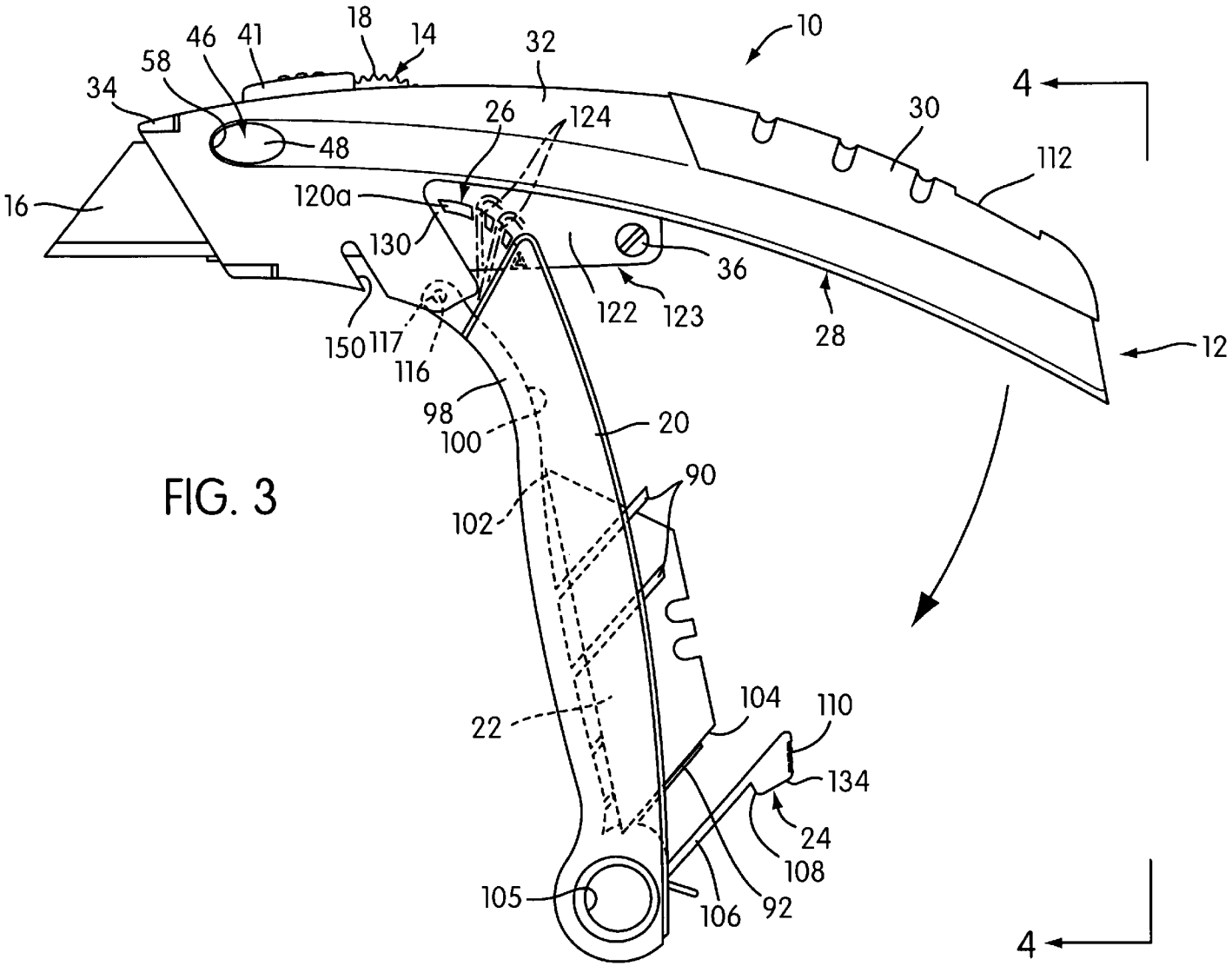
FIG. 3 is a view similar to FIG. 2 except showing the blade storage member in its opened position.
Figure 4:
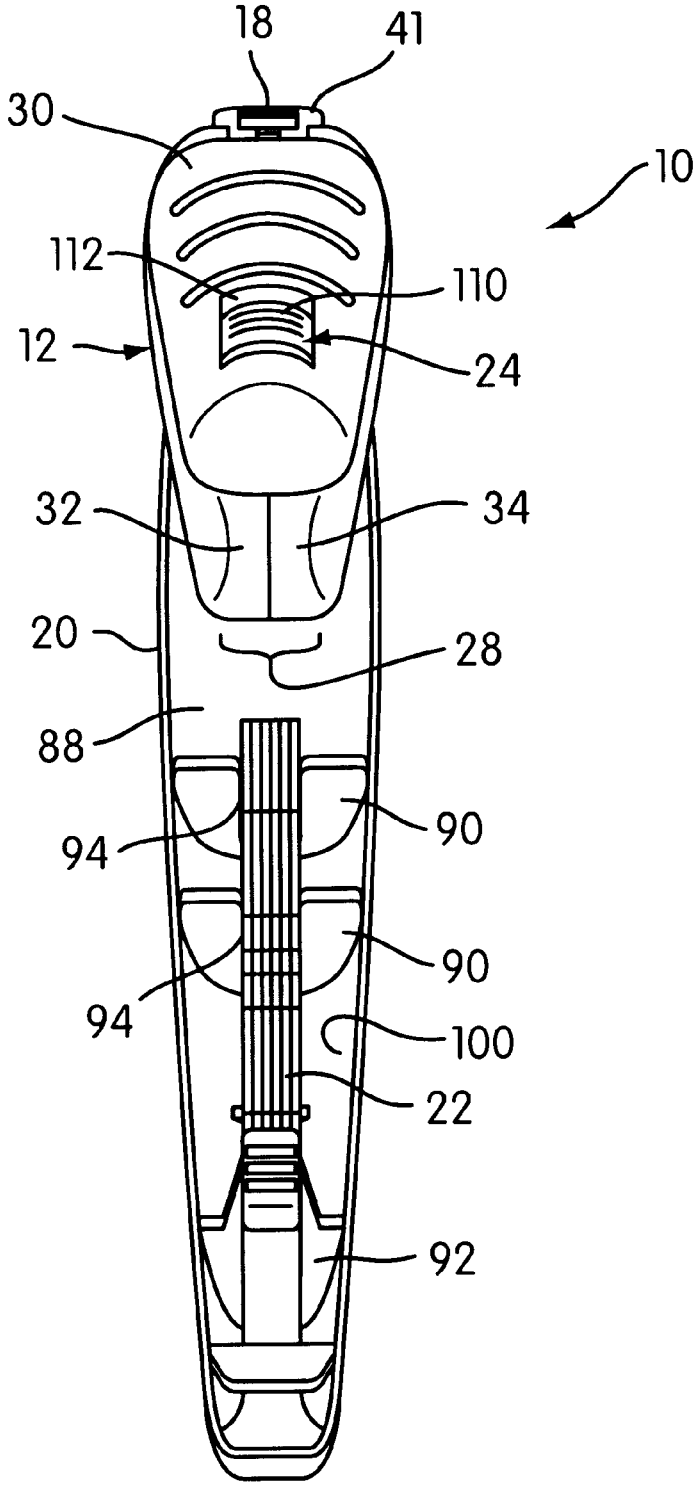
FIG. 4 is a rear plan view of the utility knife with the blade storage member in its opened position as indicated in FIG. 3.

A blade storage member 20 is pivotally connected with the main body 12 in a manner best seen in FIGS. 2–3 and is constructed and arranged to carry a plurality of conventional blades 22. The blade storage member 20 is movable between a closed position (shown, for example, in FIG. 2) wherein the spare blades 22 are concealed and a fully opened position (shown, for example, in FIG. 3) wherein the user is permitted to access the spare blades 22. The utility knife 10 further includes releasable locking structure 24 that is constructed and arranged to releasably lock the blade storage member 20 in its closed position. Interengaging structure 26 (best seen in FIGS. 1–3) between the blade storage member 20 and the main body 12 prevents movement of the blade storage member 20 from its closed position to its fully opened position under the force of gravity when the releasable locking structure 24 is released to unlock the blade storage member 20 from its closed position. Preferably, the interengaging structure comprises cooperable detents or protrusions on the blade storage member 20 and the main body 12, as will be described later in greater detail.

The main body portion 12 is comprised of a body structure 28 and an upper gripping member 30. The body structure 28 is preferably made of an appropriate metal (preferably aluminum or steel) or other material of suitable strength and is comprised of two mating body halves 32, 34. The body halves 32, 34 are secured together to form the body structure 28 of the main body portion 12 by a threaded or other type of conventional fastener 36 (best seen in FIGS. 2–3) and the upper gripping member 30 is mountable on the body structure 28 in a position to engage the palm of a gripping hand to provide the palm with a comfortable gripping surface.

Figure 11:
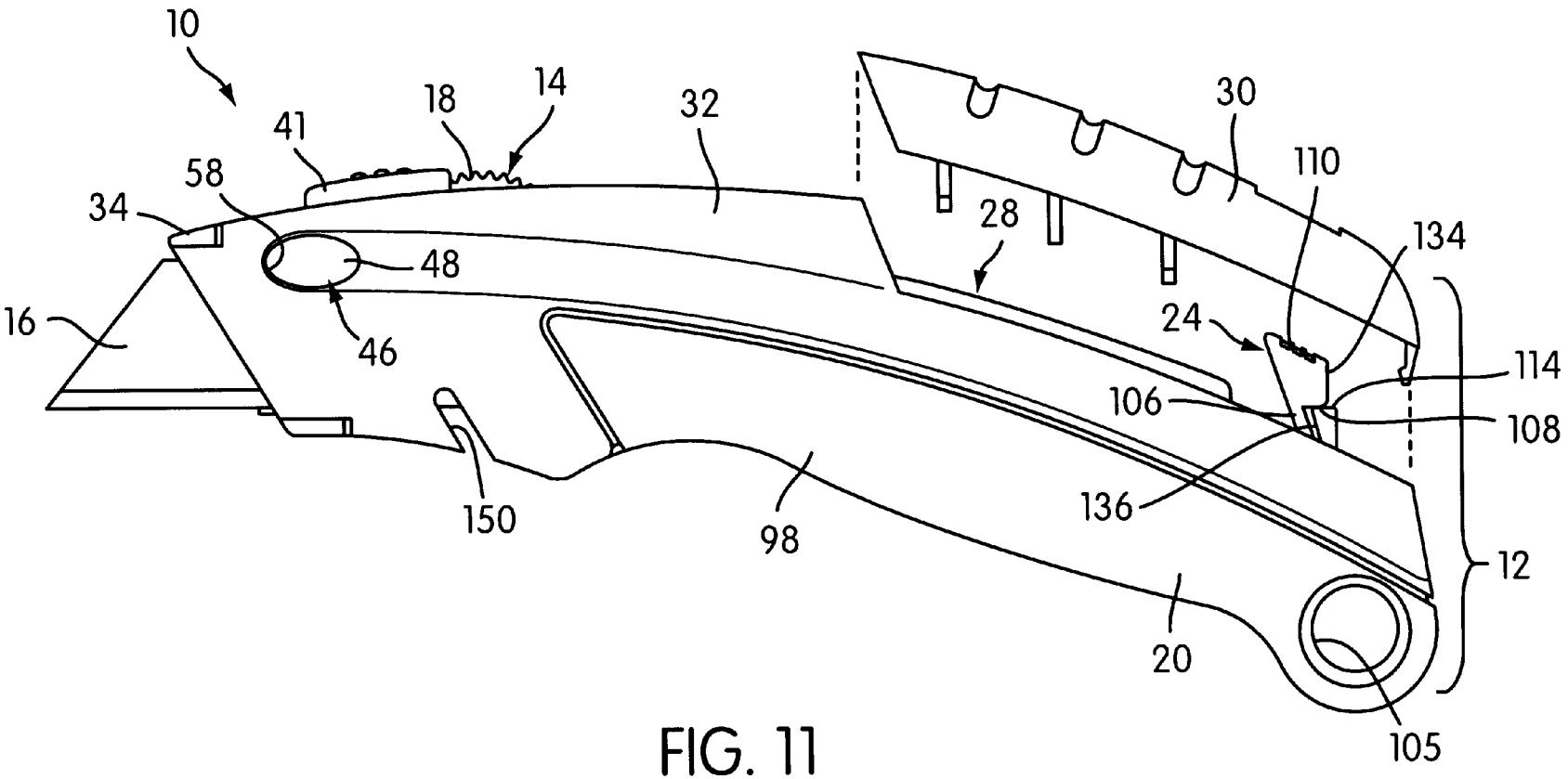

The upper gripping member 30 is preferably made of a suitable molded plastic and is snap-fit onto the metal body structure 28. The upper gripping member 30 is provided with a plurality of downwardly extending legs 37 best seen in FIG. 11 that each terminate in integral hook-like structures 39. The body structure 28 is provided with a plurality of wells (not shown) shaped to receive the legs 37 and having structure that hookingly engages the hook-like structures 39 on the legs to secure the upper gripping member 30 to the body structure 28.

The body halves 32, 34 cooperate to form an upper slot 38 for the manually engageable member 18 and a front slot 40 (best seen in FIGS. 9–10) sized to allow the blade 16 mounted in the blade holder assembly 14 to move in and out of the main body 12. The body halves 32, 34 cooperate to retain a thumb grip member 41 in a position to receive and support the thumb of the gripping hand of the user. The thumb grip member 44 is preferably made of an appropriate molded plastic and is provided with a groove 42 (see FIGS. 7 and 8) that engages a rib 44 formed in a recess or well 46 on the body structure 28 when the body halves 32, 34 are secured together to hold the grip member 41 on the body structure 28.

The interior of the body structure 28 is configured to slidably receive the blade holder assembly 14 therein for longitudinal movement with respect thereto. The blade holder assembly 14 is shown in isolation in FIG. 5 with a blade 16 and a blade releasing structure 46 shown in exploded view. The blade releasing structure 46 is associated with the blade holder assembly 12 and includes a manually engageable portion 48 that is movable to disengage the blade 16 from the blade holder assembly 14 to enable the blade 16 to be removed from the blade holder assembly 24.

Figure 9:
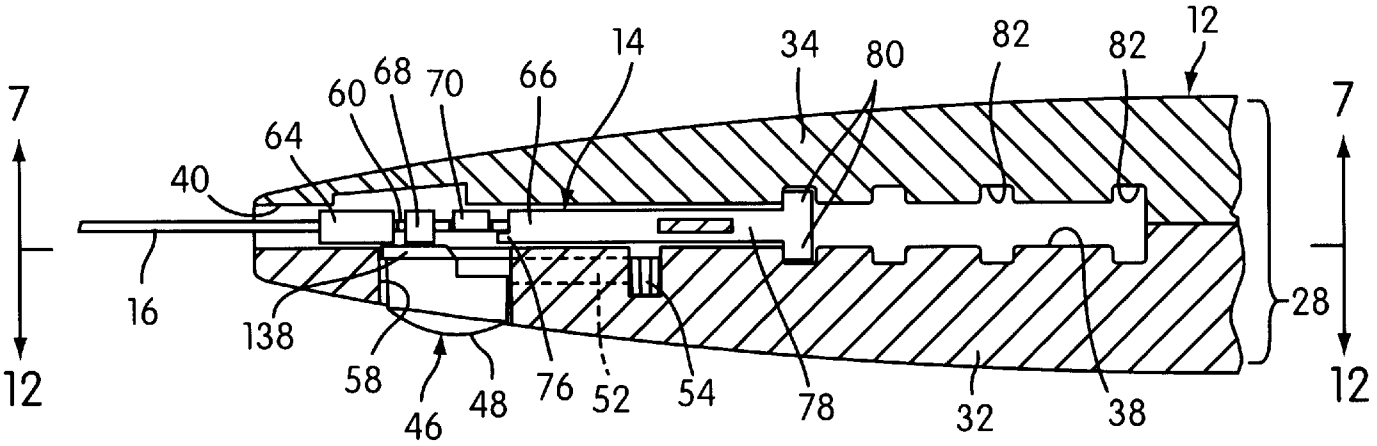
FIG. 9 is a cross-sectional view of the utility knife taken along the line 9—9 in FIG. 2 showing the blade holder assembly in the fully extended position.
Figure 10:
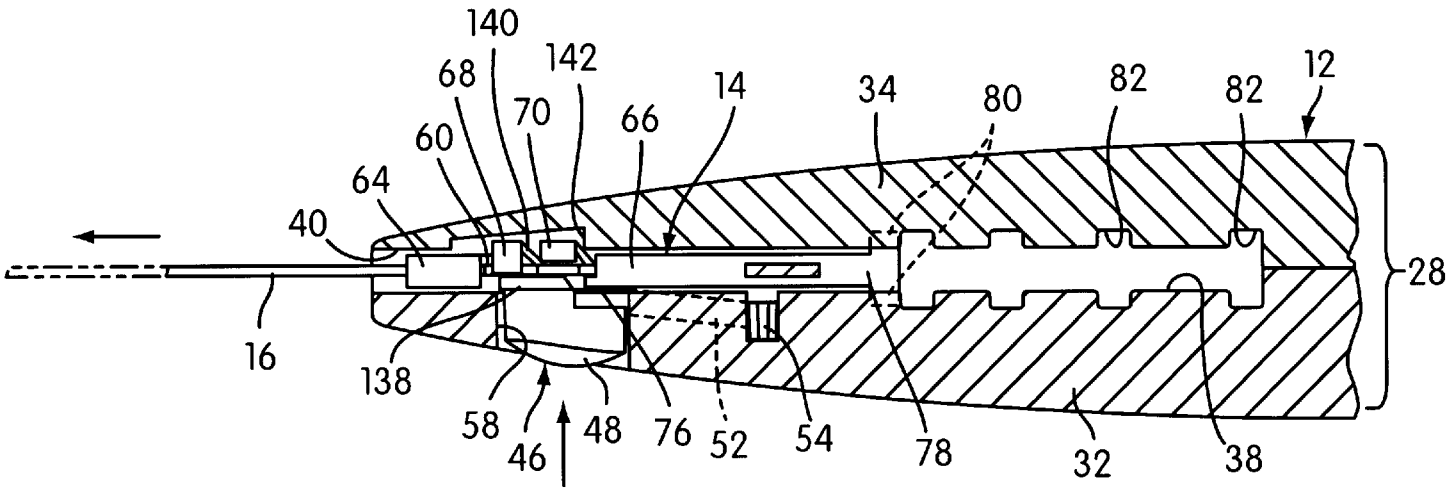
FIG. 10 is a view of utility knife similar to the view of FIG. 9 except showing the blade holder assembly in the blade mounting and releasing position.
Figure 12:
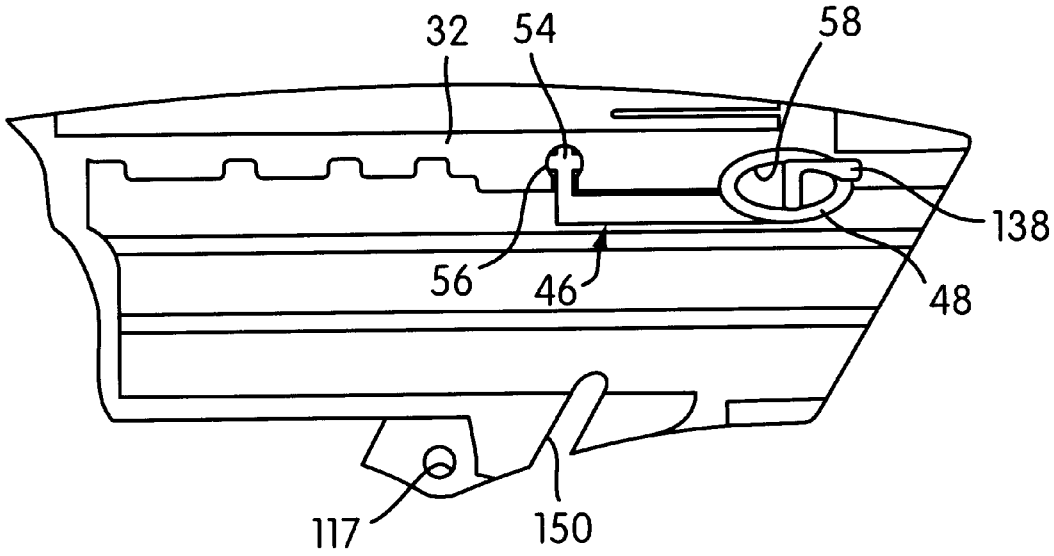
FIG. 12 shows the blade releasing structure connected with a body half of the utility knife.

The blade releasing structure 46 includes an attachment portion 54 connected with one of the body halves 32 in a manner best appreciated from FIGS. 9–10, 12. Preferably the blade releasing structure 46 is an integral, resilient structure made of a suitable molded plastic. The blade releasing structure 46 includes a resilient arm member 52 that extends integrally outwardly from the manually engageable portion 48 to the attachment portion 54 at the opposite end thereof. The one body half 32 is provided with a bore 56 and a lateral aperture 58. The blade releasing structure 46 is mounted to the one body half 32 by press fitting the attachment portion 54 into the bore 56 and allowing the manually engageable portion 48 to be slidably received within the lateral aperture 58 to permit lateral movement of the manually engageable portion 48 with respect to the body half 32 of the main body 12 between a neutral or blade retaining position and a releasing position. Preferably, the resilient arm member 52 is constructed and arranged to bias the manually engageable portion 48 outwardly from the main body, toward its neutral position. The attachment portion 54 retains the blade releasing structure 46 with the one body half 32 when the body halves 32, 34 of the body structure 28 are disconnected from one another so that the blade releasing structure 46 does not become associated with the main body when the utility knife 10 is disassembled.

Figure 5:
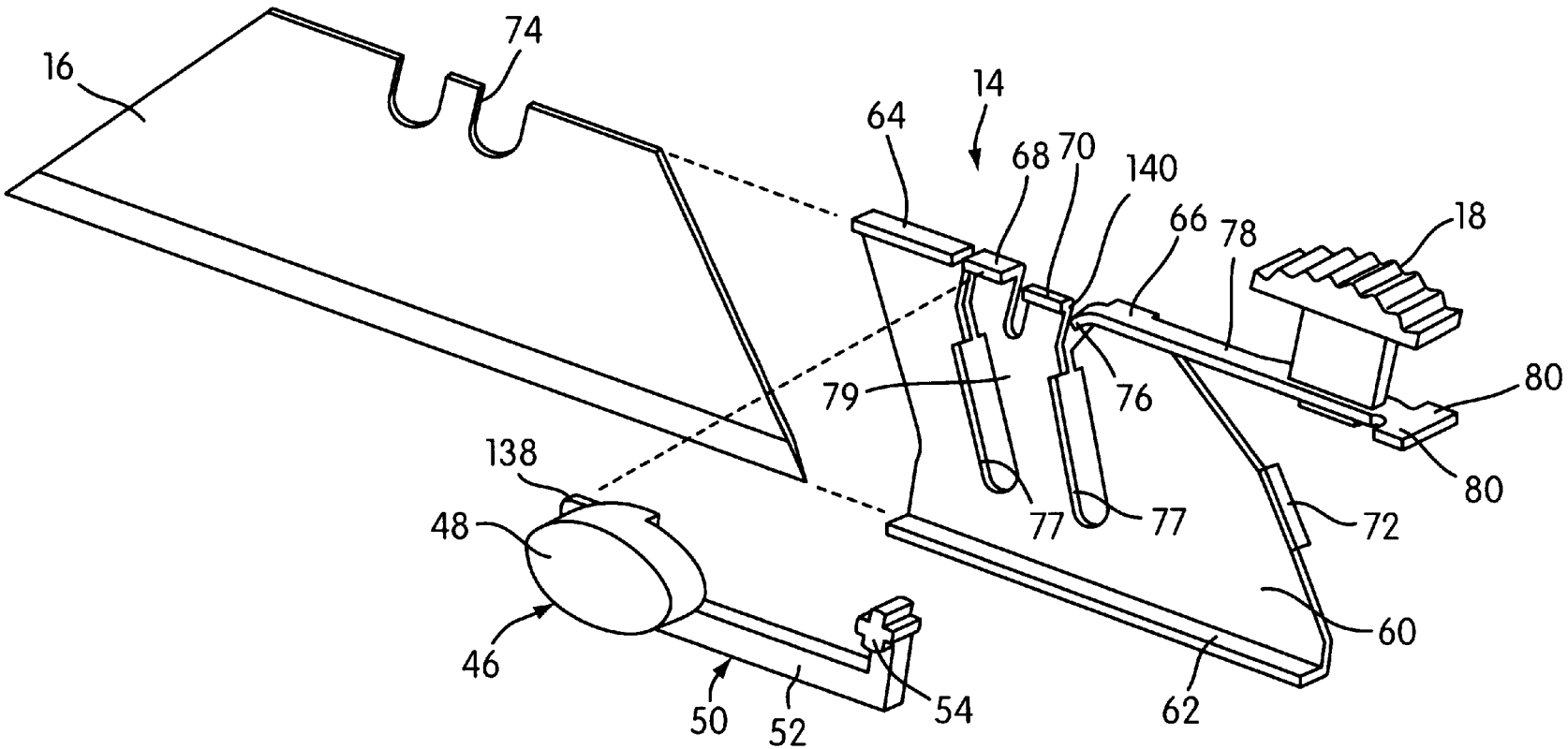
FIG. 5 is an isolated exploded view of a blade holder assembly, a blade releasing structure, and a single utility knife blade in accordance with the utility knife of the present invention.

The structure of the blade holder assembly 14 is best understood from examining FIG. 5. The structure of the blade holder assembly 14 is described in more detail in commonly assigned U.S. Pat. No. 4,586,256, which patent is hereby incorporated by reference in its entirety. The manner in which the blade 16 is removably mounted in the blade holder assembly 14 is best appreciated from FIGS. 5–8 and the manner in which the blade holder assembly 14 is slidably mounted within the main body 12 can best be understood by examining FIGS. 7–10.

The present invention is concerned with the manner in which the interengaging structure 26 between the blade storage member 20 and the main body 12 prevents movement of the blade storage member from its closed position to its fully opened position under the force of gravity when the releasable locking structure is released to unlock the blade storage member from the closed position; the manner in which the attachment portion 50 retains the blade releasing structure 46 to the one body half 32 of the main body 12; and the manner in which the blade storage member 20 conceals the fastener 36 that secures the two halves 32, 34 together when the blade storage member 20 is in its closed position. The structure of the blade holder assembly 14 and the manner in which the same is slidably mounted within the body portion 12 of utility knife 10 may be conventional, but is preferably as described in the above incorporated patent; consequently, the structure of the blade holder assembly 14 and the manner in which the same is slidably and lockably, releasably mounted therein for movement between retracted and extended positions will not be considered in detail.

The blade holder assembly 14 includes a generally upright planar blade support 60 which is provided with a plurality of integral, generally perpendicular flanges. These flanges include a lower flange 62 along a bottom edge, a forward upper flange 64, a rear upper flange 66, an intermediate upper flange 68 and a blade locking central flange (or lug) 70 generally along a top edge. A back flange 72 is integrally formed along a back edge of the blade support 60. Preferably the blade support 60 and the structures integrally formed therewith are made of an appropriate metal material, such as aluminum or steel.

Figure 6:
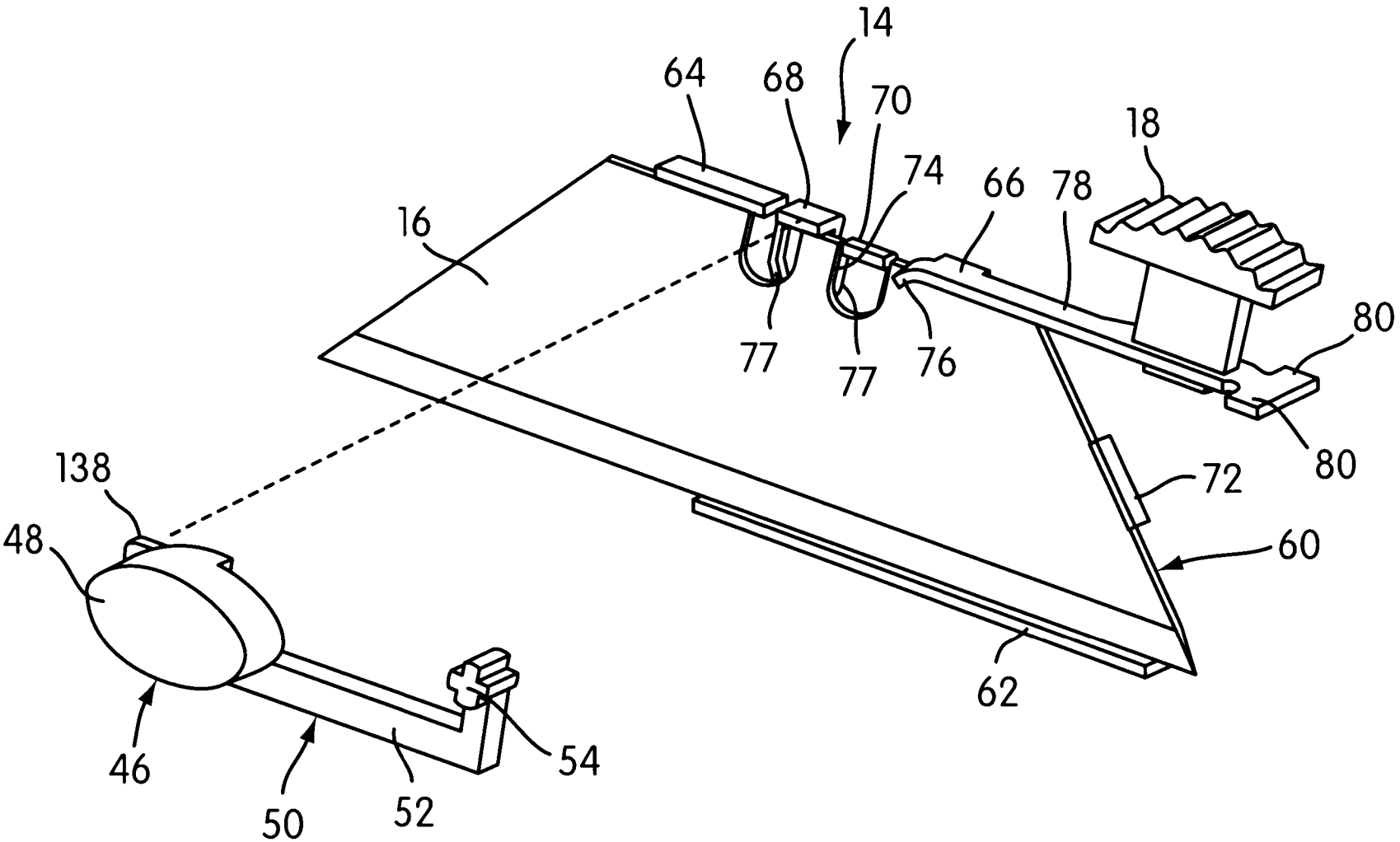
FIG. 6 is a view similar to FIG. 5 except showing the conventional utility knife blade in engagement with the blade holder assembly of the utility knife.

As shown in FIG. 6, when the blade 16 is mounted in the blade holder assembly 14, it is the held therein by the flanges 62, 64, 66, 68, 72, which engage edge portions of the blade 16, and by the central flange or lug 70 disposed within a notch 74 formed in the top of the blade 16 to prevent the blade 16 from moving longitudinally forwardly or rearwardly out of engagement with the blade holder assembly 16. An integral lateral retention tab 76 extends from the rear flange 66 to help secure the blade 16 within the blade holder assembly 14. Two slots 77 are formed within the blade support 60 and define a central portion 79 of the planar blade support 60 (see FIG. 5).

Figure 7:
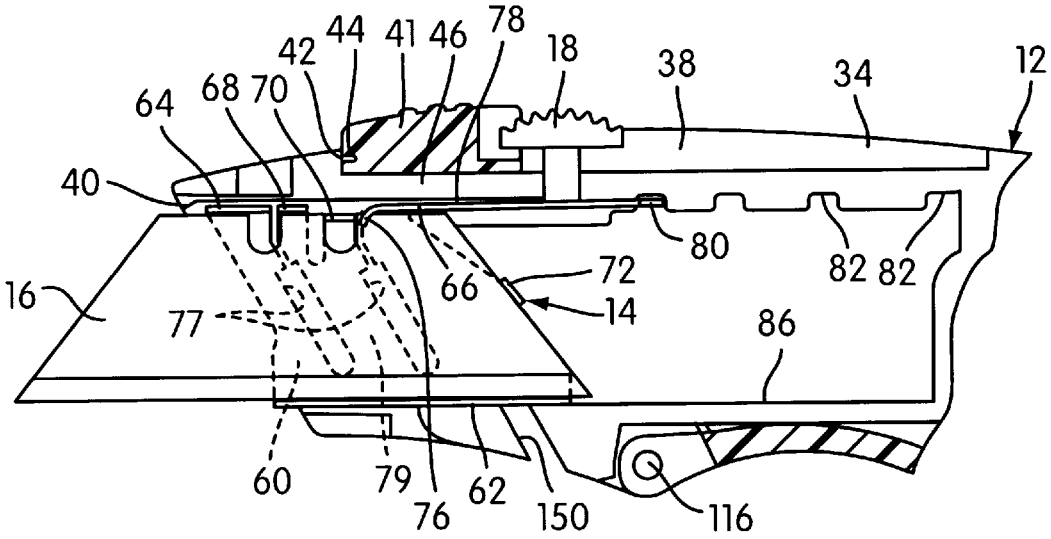
FIG. 7 is a fragmentary view of a body half of the utility knife and showing the blade holder assembly and the conventional blade in a fully extended position and showing a partial cross-sectional view taken to the line 7—7 of FIG. 9 of a fragment of the blade storage member and a full cross-sectional view of a thumb engaging member of the utility knife.

A resilient finger structure 78 extends integrally rearwardly from the rear flange 66 and terminates in a pair of laterally outwardly extending locking tabs 80 that are sized to be received within longitudinally spaced locking notches 82 formed within the main body 12 of the utility knife 10 (e.g., see FIG. 7). The manually engageable member 18 is rigidly attached to the finger structure 78 and is disposed within the upper slot 38 of the main body 12 in a position to be engaged by a thumb of the gripping hand of the user. The blade holder assembly 14 is slidably mounted generally within a channel 86 formed within the main body 12 for movement between the retracted and extended positions.

The blade storage member 20 has an interior chamber 88 (best seen in FIG. 1) that is constructed and arranged to receive a supply of spare blades 22. A plurality of ribs 90 and a wall portion 92 are integrally formed within the chamber 88 to the support the blade 22. Each rib 90 has a rectangular shaped notch 94 formed therein and these notches 94 are aligned in a generally longitudinal direction to receive the supply of spare blades 22. As can best be appreciated from FIG. 3, the wall portion 92 of the blade storage member 20 is appropriately angled to abutting engagement and support a side edge 104 of each of the blades 22. The exterior surface 98 of the blade storage member 20 is contoured to comfortably receive the fingers of the gripping hand of the user and the interior surface 100 (shown in phantom in FIG. 3) of the blade storage member 20 is shaped to abuttingly engage a corner portion 102 of each blade 22 stored therein. It can therefore be appreciated that when the supply of blades 22 is stored in the blade storage member 20 and storage member 20 is closed, the blades 22 are maintained in the storage position by the cooperation of the notches 94, the wall portion 92, the interior surface 100 and at least one surface (not shown) on the body structure 28 that abuttingly engages the back edges 104 of the blades 22. The blade storage member is provided with an attachment aperture 105 to facilitate attachment of the utility knife 10 to a tool belt or to provide a way to hang the knife for storage when not in use.

The releasable locking structure 24 is preferably a flexible, resilient structure integrally molded on the blade storage member 20 in a manner best seen in FIGS. 1–3. The releasable locking structure 24 includes a resilient, flexible stem 106, a locking surface 108 and an engageable end surface 110. A rear portion of the main body 12 is provided with an aperture 112 (best seen in FIG. 2) configured to receive the releasable locking structure 24. When the releasable locking structure 24 is received within an aperture 112, a locking surface 114 formed on the body structure 28 releasably lockingly engages the locking surface 108 on the locking structure 24 to locking the blade storage member 20 in its closed position.

The blade storage member 20 is pivotally mounted to the main body portion 12 of the utility knife 10 by a pair of transversely, oppositely extending cylindrical projections 116 integrally formed at a forward end thereof as best appreciated from FIGS. 1, 3 and 7–8. Each cylindrical projection 116 (only one of which is visible in FIGS. 1, 3 and 7–8) is pivotally received within a pair of transversely aligned cylinder bores 117 formed on respective halves 32, 34 of the body structure 28 of the main body 12.

In the preferred embodiment, a lip structure 118 is formed on the interior surface 100 of the blade storage member 20 at the forward end thereof to form part of the interengaging structure 26. The preferred interengaging structure 26 is also comprised of an arcuate spaced array of raised structures or detents, generally designated 120, integrally formed on transversely outwardly facing surfaces 122 of a downwardly projecting portion 123 of the body structure 28 of the main body portion 12. Only one side surface 122 of the downwardly projecting portion 123 is visible in the drawings, but the side surface of the portion 123 that is not visible and the series of detents formed thereon are of mirror image construction. Thus, the description of side 122 and the array of detents 120 formed thereon is applicable to the opposite side of the downwardly projecting portion 123 as well.

A series of notches or recesses 124 are formed between the detents 120 and each recess 124 is sized and positioned to receive the lip structure 118 of the blade storage member 20. It can be appreciated that because the blade storage member 20 s made of a resilient molded plastic, the lip structure 118 can move into engagement with successive recesses 124 as the blade storage member 20 is moved from its closed position to its open position. Preferably, the sides of the raised structures 120 that define the recesses 124 are appropriately angled to facilitate movement of the lip structure 118 into and out of engagement with each recess 124.

While the above lip/detent arrangement is described as the preferred interengaging structure, it should be appreciated that any type of surface engagement between the blade storage member 20 and the main body 12 (e.g., a frictional engagement, etc.) that would prevent movement of the blade storage member 20 to the fully opened position under the force of gravity can be employed. Thus, the present invention requires a force greater that the force of gravity to move the storage member to its fully opened position.

OPERATION

The operation of the utility knife 10 will be described assuming that there is no blade initially mounted within the blade holder assembly 14 and that there is a supply of blades 22 in the blade storage member 20. To access the supply of blades 22, the user engages the upper surface 110 of the releasable locking structure 24 with a thumb or finger and pushes the surface 110 forwardly and downwardly, causing the stem 106 to resiliently bend to move the locking surface 108 on the locking structure 24 out of engagement with the locking surface 114 on the main body 12 of the knife 10. The user may thereafter pivotally move the blade storage member 20 from its closed position downwardly toward its opened position. It can be understood that when the blade storage member 20 is in its closed position, the lip structure 118 is abuttingly engaged with a forwardly facing edge 130 of the forwardmost raised structure 120 and in abutting engagement with the side surface 122 of the body portion 28. The engagement between the lip structure 118 and the edge 130 prevents the blade storage member 20 from moving toward its opened position until the user pushes the blade storage member with sufficient force to cause the resilient outward expansion of the lip structure 118 to allow the same to move past the first pair of raised structures, designated 120*a* for reference.

As the blade storage member 20 is forced to pivot downwardly, the lip structure 118 enters the successive recesses 124 defined by the raised structures 120 and then moves outwardly thereof, resiliently expanding to allow the lip structure 118 to move over the successive raised structures 120. It can be appreciated that this engagement between the lip structure 118 and the raised structures 120 prevents rapid movement of the blade storage member 20 toward and into its fully opened position under the force of gravity, thereby preventing the storage member 20 from falling open. The user must apply a moderate pushing force on the blade storage member 20 to affect the movement of the same with respect to the body structure 28 from its fully closed position to its fully opened position. The lip structure 118 and the raised structures 120 therefore cooperate to provide interengaging structure that controls the opening movement of the storage member 20.

When the storage member 20 is fully opened, the user removes one of the blades from the supply of blades 22 and then pushes the blade storage member 20 in its closing direction to its closed position to re-lock the member 24. The user must exert a force on the blade storage member 20 of sufficient magnitude to move the lip structure 118 over the array of raised structures 120 until the member 20 is closed. The relocking of the blade storage member 20 can be understood from FIG. 2. More specifically, as the blade storage member 20 moves toward its closed position, a rearwardly facing surface 134 on the releasable locking structure 24 contacts an angled surface 136 formed on the body structure 28 and further movement of the blade storage member 20 toward its closed position thereafter causes the surface 134 to slide over surface 136. As the releasable locking structure 24 slides over the surface 136, the stem 106 bends resiliently forwardly to allow the locking surfaces 108, 114 to move back into locking engagement. When the blade storage member 20 reaches its closed position, the surface 134 has moved past surface 136, thereby allowing the stem 106 to move resiliently back to a neutral or equilibrium position (shown in FIG. 2) to bring the locking surfaces 108, 114 into locking engagement.

The blade holder assembly 14 is slidably mounted within the channel 86 formed in the interior of the main body portion 12. The locking tabs 80 and the locking notches 82 cooperate to releasably lock the blade holder assembly 14 in a selected one of a plurality of positions including a fully retracted position, a fully extended position, and at least one intermediate extended position. When the user depresses the manually engageable member 18 with the thumb, the finger structure 78 resiliently moves downwardly, thereby moving the tabs 80 out of locking engagement with a notch 82 in which it was disposed. While holding the manually engageable member 18 in the downward, unlocked position, the user can then exert a pushing or pulling force in the longitudinal direction to slide the blade holder assembly 14 in the generally longitudinal direction between retracted, fully extended, and intermediate positions.

Figure 8:
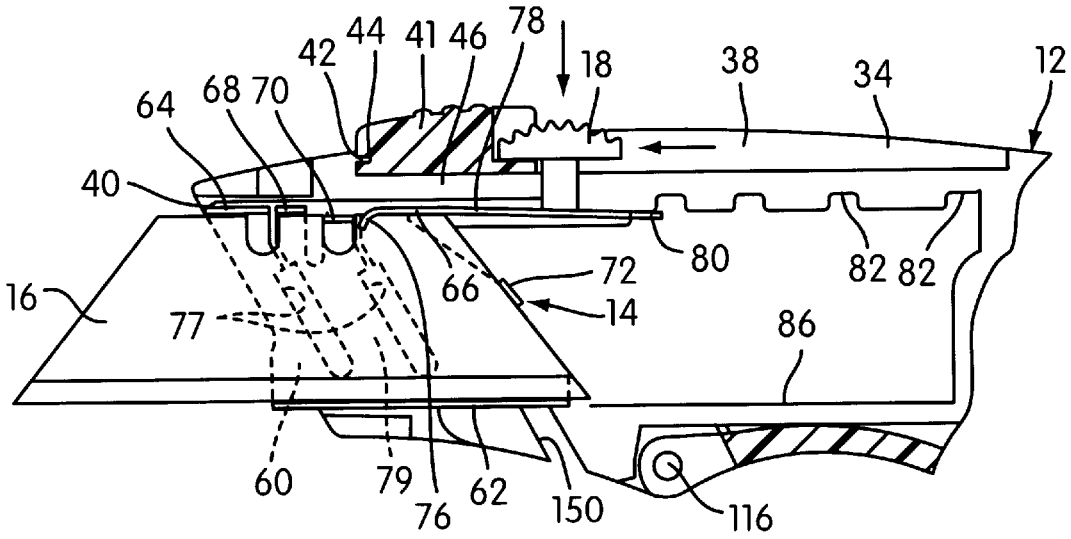
FIG. 8 is a view similar to FIG. 7 except showing the blade holder assembly in a blade mounting and releasing position.

FIG. 7 shows a cross-sectional view of a fragment of the utility knife 10 when the blade holder assembly 14 is in its fully extended, locked position and FIG. 8 shows a similar view when the blade holder assembly 14 is in a blade mounting and releasing position. To mount the selected blade 16 in the blade holder assembly 14, the user slides the blade holder assembly 14 to the blade mounting and releasing position which is preferably slightly beyond the fully extended, locked position of the blade holder assembly 14 (in a forward longitudinal direction). The present invention contemplates that the blade 16 can be mounted or released with respect to the blade holder assembly 14 only when the blade holder assembly 14 is in the blade mounting and releasing position. While this position is preferably slightly forwardly beyond the fully extended position for normal use in a cutting operation, it is alternately contemplated that the fully extended position for use may itself also institute the mounting and releasing position. For the purpose of this description and appended claims, "the fully extended position" shall refer to both of these possibilities. While holding the manually engageable member 18 in the fully extended (or mounting and releasing) position, the user depresses manually engageable portion 48 of the blade releasing structure 46, thereby causing a longitudinally extending arm structure 138 integrally formed on the blade releasing structure 46 to move into abutting engagement with the intermediate flange 68 on the blade holder assembly 14. Continued transverse inward movement of the manually engageable portion 48 thereafter causes the central portion 79 of the blade support 60 to resiliently move out of its equilibrium position, thereby moving the central flange 70 from a blade locking position to a blade releasing position. The blade releasing position of the central flange 70 is shown in FIG. 10.

It can be appreciated from FIG. 10 that when the central portion 79 of the blade holder assembly 14 is biased outwardly into the blade releasing position, a rearward edge 140 thereof is longitudinally aligned with a forwardly facing wall portion 142 of the body structure 28. The user can then release the manually engaging member because abutting engagement between the edge 140 and the wall portion 142 will maintain the blade holder assembly in its blade releasing and mounting position as long as the user maintains the manually engageable portion 48 of the blade releasing structure 46 in its depressed, blade releasing position.

The user then inserts the new blade 16 into the blade holder assembly 14 until a side edge of the blade 16 is in abutting engagement with the back flange 72 on the blade support 60. The user then releases the manually engageable portion 48 of the blade releasing structure 46, allowing the central portion 79 of the blade support 60 and the flanges 68, 70 integrally formed therewith to move under the resilient spring force provided by the flexure of the central portion 79 into locking engagement with the new blade 16. When the flanges 68, 70 are in locking engagement with the blade 16, the intermediate flange 68 is in abutting, overlying relation with a top edge of the blade and the locking central flange 70 is disposed within a notch 74 formed on the blade 16. These user can then manipulate the manually engageable member 18 in a conventional manner to move the blade 16 and the blade holder assembly 14 as a unit in a generally longitudinal direction with respect to the main body portion 12 to releasably lock the blade 16 in a desired extended position to cut a workpiece or in the retracted position to store the blade when the cutting operation is completed. The main body portion 12 of the utility knife 10 is provided with a slot 150 to allow the user to cut a string safely.

To remove the blade 16 after it has become dull or broken, these user essentially reverses the blade installation procedure described above. More specifically, the user moves the blade holder assembly 14 fully longitudinally forwardly to the blade mounting and releasing position and, while holding the assembly 14 in this position, pushes the manually engageable portion 48 of the blade releasing structure 46 transversely inwardly to the position shown in FIG. 10. While holding the manually engageable portion 48 in its blade releasing position, the user can then slide the blade forwardly out of the blade holder assembly 14 and either insert a new blade or turn the old blade 180 degrees and reinsert the old blade so that a sharp edge thereof is exposed. The user then releases the manually engageable portion 48 to allow the locking central flange 70 to move back into locking engagement with the blade. The utility knife 10 is again ready for use in a cutting operation.

It can be appreciated from a comparison of FIGS. 9 and 10 that the resilient integral arm member 52 which forms part of the attachment portion of the blade releasing structure 46 resiliently biases of the manually engageable portion 48 transversely outwardly of the body structure 28 and that attachment portion 54 retains the blade releasing structure 46 with the one body half 32 of the body structure 28 when the body halves 32, 34 are disconnected from one another. More specifically, it can be understood that although is not necessary to separate the body halves 32, 34 by removing the threaded faster 36 to either replace the blade 16 or to access the supply of store the blades 22, it may be necessary for the user to separate the body halves 32, 34, for example, to clean the interior of the main body portion 12 of the utility knife. To separate the body halves 32, 34, the user pivots the blade storage member 20 to its opened position to expose the fastener 36 and then removes the fastener 36 with a screwdriver. It can be appreciated from FIG. 12 that because the attachment portion 54 of the blade releasing structure 46 is press fit into engagement with the bore 56, the attachment portion retains the blade releasing structure 46 with the one body half 32 when the body halves 32, 34 are disconnected from one another. When the utility knife 10 is reassembled and the fastener 36 is reinstalled therein, moving the blade storage member 20 back to its closed position covers the fastener 36.

The embodiment of the utility knife 10 shown and described herein is exemplary only and is not intended to limit the scope of the invention. The specific embodiment of utility knife 10 is provided to illustrate the broad teachings of the invention. It is within the scope of the invention to provide a wide range of hand tools including a wide range of utility knives with a movably mounted storage member and to provide interengaging structure between the movable storage member and a body portion of the tool to control the opening and closing movement of the storage member with respect to the body portion. It can also be appreciated by those skilled in the art that the specific embodiment of the interengaging structure is exemplary only and not intended to limit the scope of the invention.

It can thus be appreciated that the objects of the present invention have been fully and effectively accomplished. It is to be understood that the foregoing specific embodiment has been provided to illustrate the structural and functional principles of the present invention and is not intended to be limiting. To the contrary, the present invention is intended to encompass all modifications, substitutions and alterations within the spirit and scope of the appended claims.

It should be noted that limitations of the appended claims have not been phrased in the "means or step for performing a specified function" permitted by 35 U.S.C. § 112, ¶6. This is to clearly point out the intent that the claims are not to be interpreted under § 112, ¶6 as being limited solely to the structures, acts and materials disclosed in the present application or the equivalents thereof.

What is claimed is:

1. A utility knife, comprising:

a main body;

a blade holder movably mounted within said body and constructed and arranged to mount a blade, said blade holder being movable between a retracted position wherein said blade is disposed within said main body and an extended position wherein said blade protrudes outwardly from said main body to enable a cutting operation;

a manually engageable member slidably mounted on said main body and operatively connected with said blade holder assembly, said manually engageable member being movable to move said blade holder assembly between said extended and said retracted positions;

a blade storage member pivotally connected with said main body and constructed and arranged to carry spare blades, said blade storage member being movable between a closed position wherein said spare blades are concealed and a fully opened position permitting access to said spare blades, a releasable locking structure constructed and arranged to releasably lock said blade storage member in said closed position;

interengaging structure between said blade storage member and said main body to prevent movement of said blade storage member from said closed position to said fully opened position under the force of gravity when said locking structure is released to unlock said blade storage member from said closed position.

2. A utility knife according to claim 1, wherein said main body comprises two body halves and a fastener that secures the halves to one another, said blade storage member concealing said fastener when in said closed position.

3. A utility knife according to claim 1, further comprising a blade releasing structure associated with said blade holder assembly, said blade releasing structure including a manually engageable portion which is movable to disengage said the blade from said blade holder assembly to enable said blade to be removed from said blade holder assembly, said blade releasing structure including an attachment portion connected with one of said body halves, said attachment portion retaining said blade releasing structure with said one of said body halves when said body halves are disconnected from one another.

4. A utility knife, comprising:

a main body comprising two body halves and a fastener that secures the halves to one another;

a blade holder movably mounted within said body and constructed and arranged to mount a blade, said blade holder being movable between a retracted position wherein said blade is disposed within said main body and an extended position wherein said blade protrudes outwardly from said main body to enable a cutting operation;

a manually engageable member slidably mounted on said main body and operatively connected with said blade holder assembly, said manually engageable member being movable to move said blade holder assembly between said extended and said retracted positions;

a blade storage member pivotally connected with said main body and constructed and arranged to carry spare blades, said blade storage member being movable between a closed position wherein said spare blades are concealed and a fully opened position permitting access to said spare blades, a releasable locking structure constructed and arranged to releasably lock said blade storage member in said closed position;

said blade storage member concealing said fastener when in said closed position.

5. A utility knife, comprising:

a main body comprising two body halves and a fastener that secures the halves to one another;

a blade holder assembly movably mounted within said body and constructed and arranged to mount a blade, said blade holder assembly being movable between a retracted position wherein said blade is disposed within said main body, a fully extended position wherein said blade protrudes outwardly to its fullest extent from said main body, and at least one intermediate position;

a manually engageable member slidably mounted on said main body and operatively connected with said blade holder assembly, said manually engageable member being movable to move said blade holder assembly between said fully extended, retracted, and intermediate positions;

a blade releasing structure associated with said blade holder assembly, said blade releasing structure including a manually engageable portion which is movable to disengage said blade from said blade holder assembly to enable said blade to be removed from said blade holder assembly when said blade is in said fully extended position, said blade releasing structure including an attachment portion connected with one of said body halves, said attachment portion retaining said blade releasing structure with said one of said body halves when said body halves are disconnected from one another.

6. A utility knife according to claim 5, further comprising a blade storage member pivotally connected with said main body and constructed and arranged to carry spare blades, said blade storage member being movable between a closed position wherein said spare blades are concealed and a fully opened position permitting access to said spare blades, and a releasable locking structure constructed and arranged to releasably lock said blade storage member in said closed position.

* * * * *